US007628593B2

(12) United States Patent
Mizuno et al.

(10) Patent No.: US 7,628,593 B2
(45) Date of Patent: Dec. 8, 2009

(54) HORIZONTAL TYPE SCROLL COMPRESSOR INCLUDING A FIRST SPACE AND A SECOND SPACE

(75) Inventors: Takao Mizuno, Shizuoka (JP); Mutsumi Otsuka, Shizuoka (JP); Katsuya Ohashi, Shizuoka (JP); Yasushi Izunaga, Shizuoka (JP); Mutsunori Matsunaga, Shizuoka (JP); Masashi Miyake, Shizuoka (JP); Kenji Tojo, Moriya (JP)

(73) Assignee: Hitachi Appliances, Inc., Tokyo (JP)

( * ) Notice: Subject to any disclaimer, the term of this patent is extended or adjusted under 35 U.S.C. 154(b) by 0 days.

(21) Appl. No.: 11/774,722

(22) Filed: Jul. 9, 2007

(65) Prior Publication Data

US 2008/0008614 A1 Jan. 10, 2008

(30) Foreign Application Priority Data

Jul. 7, 2006 (JP) ..... 2006-187383

(51) Int. Cl.
*F03C 2/00* (2006.01)
*F04C 2/00* (2006.01)
*F04C 18/00* (2006.01)

(52) U.S. Cl. ..... 418/55.6; 418/55.1; 418/88; 418/94

(58) Field of Classification Search ..... 418/55.1–55.6, 418/57, 88, 94, 102; 184/6.16–6.18
See application file for complete search history.

(56) References Cited

U.S. PATENT DOCUMENTS

| | | | | | |
|---|---|---|---|---|---|
| 5,345,785 | A | * | 9/1994 | Sekigami et al. | 418/55.6 |
| 5,391,066 | A | * | 2/1995 | Sawai et al. | 418/88 |
| 5,580,233 | A | * | 12/1996 | Wakana et al. | 418/94 |
| 6,050,794 | A | * | 4/2000 | Noboru et al. | 418/55.6 |
| 6,322,339 | B1 | * | 11/2001 | Mitsunaga et al. | 418/55.6 |

FOREIGN PATENT DOCUMENTS

| | | | | | |
|---|---|---|---|---|---|
| JP | 02267378 | A | * | 11/1990 | 418/55.6 |
| JP | 05026182 | A | * | 2/1993 | |
| JP | 05-126072 | | | 5/1993 | |
| JP | 06066275 | A | * | 3/1994 | 418/88 |
| JP | 2003172276 | A | * | 6/2003 | |

* cited by examiner

*Primary Examiner*—Theresa Trieu
(74) *Attorney, Agent, or Firm*—Antonelli, Terry, Stout & Kraus, LLP.

(57) ABSTRACT

A horizontal type scroll compressor is provided with a support plate separating an inside of the sealed container into a first space in which the compressor mechanism portion and the electric motor portion are stored, and a second space in which the discharge pipe is provided, and a communication path communicating a bottom portion of the first space and a space above the drive shaft within the second space in a lower side of the support plate, and regulates an oil level by the communication path in the case that the oil level difference becomes large at a time of a high-speed operation. In order to stabilize the oil supply to the bearing or the like, the oil is supplied by an oil pump provided in a shaft end portion of the drive shaft close to an oil reserving chamber.

6 Claims, 5 Drawing Sheets

HORIZONTAL TYPE SCROLL COMPRESSOR INCLUDING A FIRST SPACE AND A SECOND SPACE

FIELD OF THE INVENTION

The present invention relates to a technique for providing a scroll compressor.

DESCRIPTION OF RELATED ART

In a conventional horizontal type sealed refrigerant compressor, as disclosed in JP-A-5-126072, an inside of a sealed container is separated into a portion storing an electric motor and a compressor mechanism portion, and a space portion to which a discharge pipe is installed, by a separation plate having a resistance to a gas fluid. There is a horizontal type scroll compressor structured such as to accumulate a refrigerator oil in the space portion to which the discharge pipe is installed, and secure a necessary amount of the refrigerator oil, on the basis of the resistance of the separation plate.

In the structure described above, since a pressure in the space portion to which the discharge pipe is installed becomes lower than that in the space portion of the compressor mechanism portion at the resistance of the gas fluid, there is supposed a problem that an oil supply of a bearing becomes insufficient in a structure employing a centrifugal pump constructed by an eccentric hole having the same level of lift as the above differential pressure. Further, in the case of the related art, since the pressure difference is fluctuated by changing a rotational speed of the compressor by an inverter, it is hard to stably hold a necessary amount of oil in the space portion to which the discharge pipe is installed.

In the conventional case, if the differential pressure becomes too large, there is supposed a matter that an oil level in the discharge pipe installed space rises excessively, and flows out from the discharge pipe. On the other hand, if the differential pressure is small, the oil level descends, and it is hard to hold the necessary amount of oil in the discharge pipe installed space.

A first object of the present invention is to provide a means for moving the refrigerator oil in the discharge pipe portion space to the compressor mechanism portion in the case that the oil level in the discharge pipe installed space becomes too high due to the pressure difference, thereby preventing the refrigerator oil from flowing out of the compressor. Further, a second object is to provide an oil feeding structure which is not affected by a pressure difference generated due to a resistance of a support plate.

In the sealed type horizontal scroll compressor mentioned above, the structure is made such that the inside of the sealed container is separated into the portion storing the electric motor and the compressor mechanism portion, and the space portion to which the discharge pipe is installed, the refrigerator oil is accumulated in the space portion (the oil feeding chamber) to which the discharge pipe is installed, and a necessary amount of the refrigerator oil is secured.

FIG. 5 is a vertical cross sectional view of a conventional horizontal type sealed scroll compressor. In FIG. 5, an internal space of a sealed container 1 is separated by a support plate 12, and the support plate 12 is provided with a support plate communication hole 17 in an upper portion than a center of a rotor 7. When a refrigerant gas compressed in accordance with a rotation of a drive shaft 22 is discharged from a discharge hole 9 of a fixed scroll 2, a pressure on a side of an electric motor portion and a compressor rear portion is increased and thus, pushes down an oil level, so as to generate an oil level different h corresponding to a pressure loss of the support plate communication hole 17. The oil surface difference h is fluctuated in correspondence to a degree of the pressure loss of the support plate communication hole 17, and a magnitude of the pressure loss is determined by an area of the communication hole, a ratio between a discharge pressure and a suction pressure, a circulating amount of the refrigerant gas and the like.

In the technique mentioned above, particularly in a high-speed operating condition in which the circulating amount is enlarged in accordance with an inverter operation, there may be a case that the pressure loss is enlarged so as to enlarge the oil level difference h, and thus, the oil level ascends to come close to the discharge pipe 19, and further, the refrigerator oil flows out from the discharge pipe. In the low-speed operation, the pressure loss becomes small so as to make the oil surface difference h become small, and thus, it is impossible to secure a sufficient amount of refrigerator oil within the oil feeding chamber. Accordingly, in the technique mentioned above, it is hard to solve both the problem that the refrigerator oil flows out, and the problem that the necessary amount of oil is secured.

In the structure mentioned above, the pressure in the space portion to which the discharge pipe 19 is installed becomes lower than that in the space portion of the compressor mechanism portion at the resistance of the gas fluid. Since the bearing of the compressor exists in the pressure space in which the pressure is higher at the resistance, the lift of the centrifugal pump utilizing the centrifugal force is the same level as the pressure loss, so that there is supposed that the oil can not be necessarily supplied to the bearing sufficiently.

BRIEF SUMMARY OF THE INVENTION

A communication path is provided in an upper portion of a support plate which separates and comparts an inside of the sealed container into a portion storing an electric motor and a compressor mechanism portion and a space portion to which a discharge pipe is installed, an oil passage is provided in a lower portion of the support plate, and a communication path for stabilizing an oil level is provided.

The communication path is provided with a valve body which is normally open in an opening portion of a compressor mechanism portion, and an oil in the discharge pipe installed space can move to the compressor mechanism portion space via the communication path in the case that the oil level ascends.

In this case, the support plate has a function of separating and comparting the inside of the sealed container into the portion storing the electric motor and the compressor mechanism portion and the space portion to which the discharge pipe is installed as mentioned above, and further has another function of supporting a bearing of a drive shaft of the compressor mechanism portion.

Under a condition that a circulating amount is small in a low-speed operation, a flow path resistance value is set such that a pressure difference is obtained for obtaining a necessary oil level difference in the support plate, and in a high-speed operation in which the circulating amount is increased, the oil is moved to the compressor mechanism portion chamber side from the space to which the discharge pipe is installed via the communication path. As mentioned above, the oil is stably secured in the space to which the discharge pipe is installed, by utilizing the pressure difference generated by the support plate.

The oil is supplied to the bearing portion by assembling a hydraulic type oil feeding pump which is not affected by the pressure difference generated in the support plate. If a trochoid pump (Registered Trademark) sucks the oil in which a refrigerant is molten, the trochoid pump generates a lubrication fault due to foaming of the refrigerant gas. In the case that the trochoid pump is employed as the oil feeding pump, a suction oil feeding portion is formed as a shorter path than the conventional one for preventing a practical problem of the lubrication fault caused by the foaming phenomenon by the suction oil feeding portion from being generated. Accordingly, in the case that the trochoid is employed as the hydraulic pump, the trochoid pump is assembled in a shaft end portion of the drive shaft close to the space to which the discharge pipe is installed.

In accordance with the structure mentioned above, in the case that the oil level in the oil feeding chamber ascends higher than the oil feeding chamber opening portion of the communication path regardless of the operating condition, it is possible to keep the oil level in the oil feeding chamber at the lower position than the opening portion of the communication path by moving the refrigerator oil to the motor chamber via the communication path. Accordingly, it is possible to prevent the oil level in the oil feeding chamber from ascending too high so as not to come close to the discharge pipe, thereby preventing the refrigerator oil from flowing out via the discharge pipe. The refrigerator oil does not flow out from the discharge pipe.

Further, the refrigerator oil moved from the communication path can be reserved in the motor chamber, and it is possible to increase a retention amount of the refrigerator oil. Further, since the hydraulic pump is employed as the oil feeding pump, it is possible to stably supply the oil to the bearing regardless of the fluctuation of the resistance of the support plate, and it is possible to secure a reliability of the compressor.

In accordance with the present invention, it is possible to provide the compressor in which the reliability is improved in comparison with the conventional one.

Other objects, features and advantages of the invention will become apparent from the following description of the embodiments of the invention taken in conjunction with the accompanying drawings.

BRIEF DESCRIPTION OF SEVERAL VIEWERS OF THE DRAWINGS

DETAILED DESCRIPTION OF THE INVENTION

A description will be given below of an embodiment in accordance with the present invention with reference to the accompanying drawings.

Embodiment 1

A description will be given of a whole structure of an embodiment in accordance with the present invention with reference to FIG. 1. FIG. 2 is a detailed view of FIG. 1. A description will be given below with reference to FIGS. 1 and 2.

A compressor mechanism portion and an electric motor portion are stored in a sealed container 100, and an inner space of the sealed container is comparted into a space storing the compressor mechanism portion and a space to which a discharge pipe is installed, by an auxiliary frame 160 and a support plate 162 fixed to the sealed container and supporting the auxiliary frame.

Figure 1:
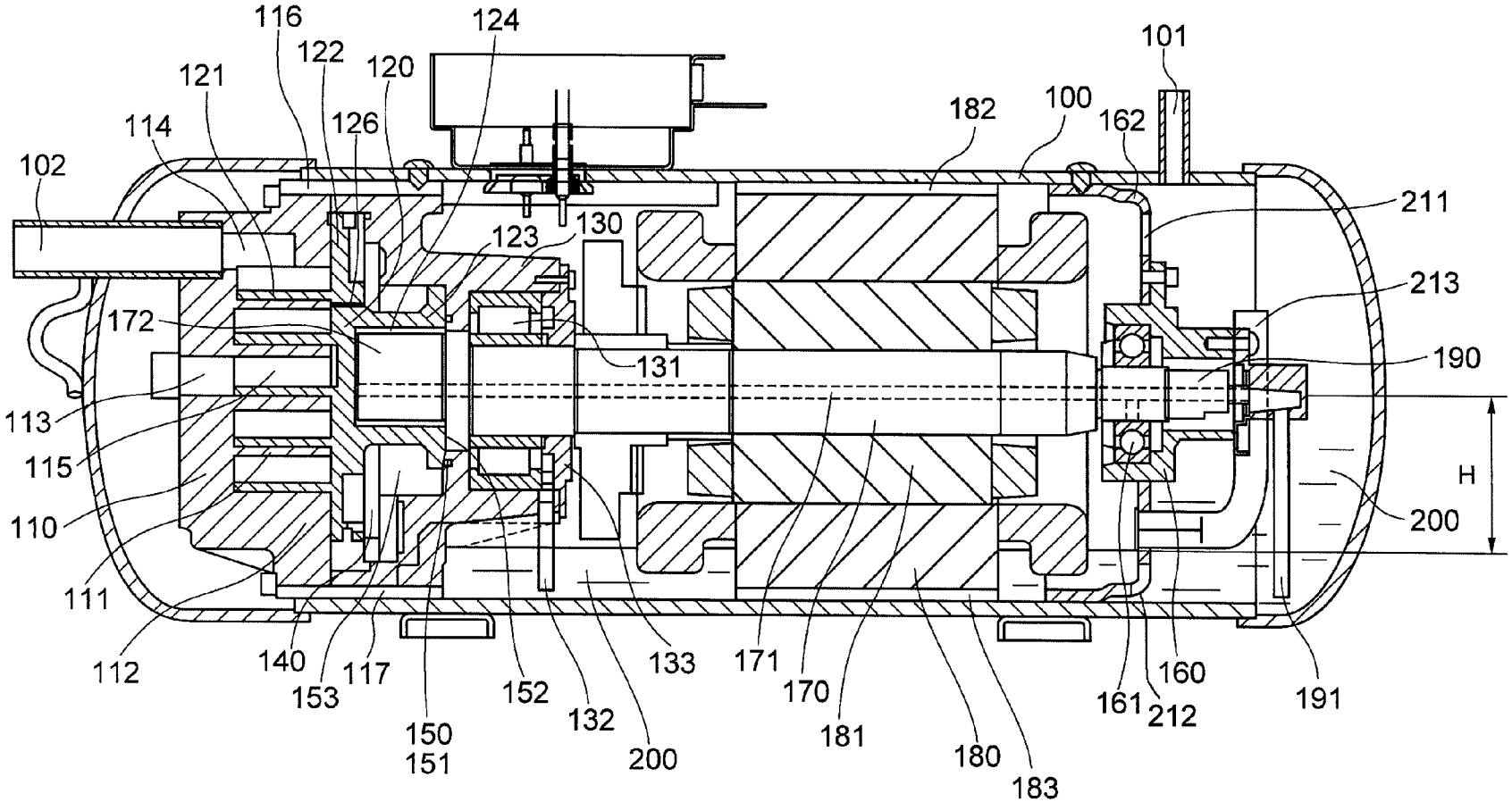
FIG. 1 is a view showing a cross sectional structure of a compressor of an embodiment in accordance with the present invention.
Figure 2:
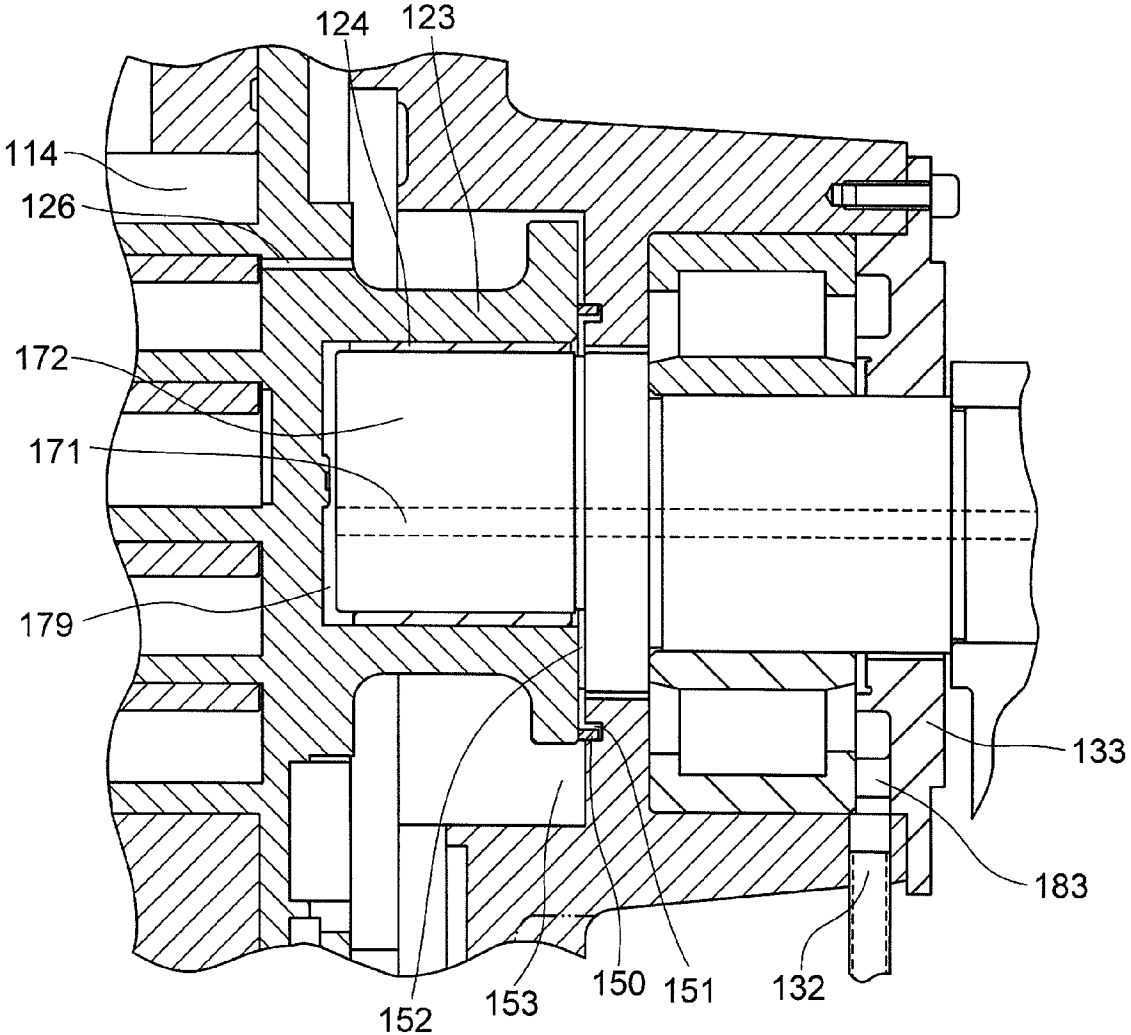
FIG. 2 is a partly enlarged view of FIG. 1.
Figure 3A:
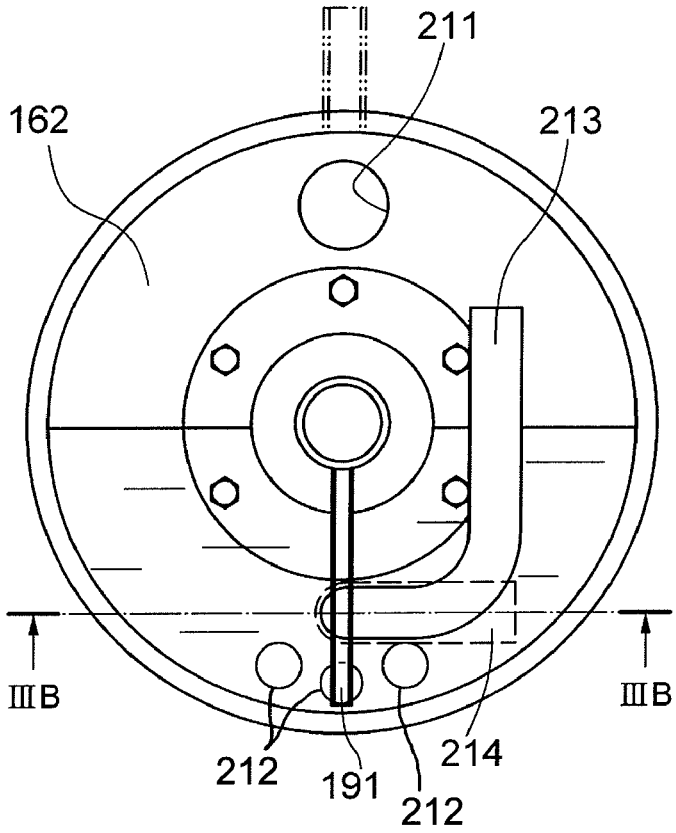
FIG. 3A is a right side elevational view of FIG. 1.
Figure 3B:
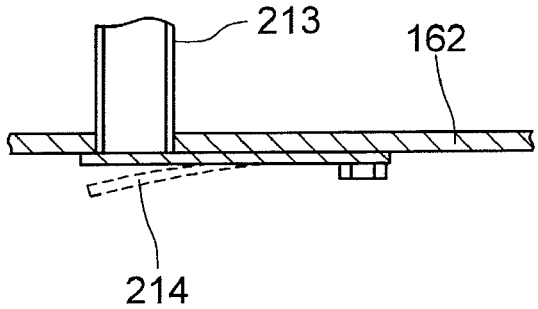
FIG. 3B is a cross sectional view taken along a line IIIB-IIIB in FIG. 3A.

As shown in FIG. 3 explaining a right side elevational view of FIG. 1, the support plate 162 has a communication path 211 forming a gas passage at an upper portion and a communication path 212 forming an oil passage at a lower portion, and has a communication path 213. The communication path 213 is open to a compressor mechanism portion chamber side at a lower position of the support plate 162 and is open to a position lower than the discharge pipe and upper than a center of rotation of an electric motor rotor. A valve 214 which is normally in an open state is attached to an opening portion of the communication path 213 close to the compressor mechanism portion.

The communication path 213 may have a pipe and a communication pipe as shown in FIG. 3, however, is not limited to the structure using the pipe and the communication pipe. For example, the communication path may be structured by appropriately using a member having a function of the pipe and the communication pipe.

As shown in FIG. 1, a basic element of the compressor mechanism portion is constituted by a fixed scroll 110, an orbiting scroll 120, a main frame 130, an Oldham ring 140, an auxiliary frame 160 and a drive shaft 170, and the frame 130 and the auxiliary frame 160 are fixed to the sealed container 100.

As shown in FIG. 1, a basic structure portion of the fixed scroll 110 is constituted by a lap 111, an end plate 112 and a discharge port 113, and the orbiting scroll 120 is constituted by a lap 121, an end plate 122 and a bearing support portion 123. A compression chamber is structured by engaging the fixed scroll 110 and the orbiting scroll 120.

A basic element of a driving portion driving so as to swing the orbiting scroll 120 is constituted by an electric motor stator 180 fixed to the sealed container, a rotor 181, the driving shaft 170, the Oldham ring 140 corresponding to a rotation preventing mechanism part of the orbiting scroll 120, a main bearing 131 and an auxiliary bearing 161 rotatably engaging the main frame 130 with the driving shaft 170 and constructing a shaft support portion of the driving shaft 170, an eccentric pin portion 172 of the orbiting scroll 120 and the driving shaft 170, and the bearing support portion 123 of the orbiting scroll engaging so as to be movable in a thrust direction and be rotatable. The main bearing 131 and the auxiliary bearing 161 of the driving shaft 170 are arranged on the compression chamber side of the electric motor and an opposite compression chamber side.

A trochoid pump 190 is provided at a shaft end portion of the driving shaft 170 on a discharge pipe installed chamber side, and an oil feeding pipe 191 constructing an oil feeding passage so as to be open to a lower portion of the sealed container is attached to the trochoid pump.

The driving shaft 170 is rotationally driven by the electric motor rotor 181, and the orbiting scroll 120 is swung on the basis of the rotation of the driving shaft, whereby the compressor chamber reduces a volumetric capacity and a compression operation is executed. The Oldham ring 140 is arranged in an outer peripheral space 153 of a space structured by the main frame 130 and the fixed scroll 110 together with the orbiting scroll 120, thereby preventing the orbiting scroll from rotating its own axis on the basis of a sliding motion of two sets of orthogonal keys (not shown) formed in the Oldham ring 140, and making it possible to compress the gas.

A working fluid is sucked into the compression chamber via a suction port 102 and a suction space 114 in accordance with the swinging motion of the orbiting scroll 120. The sucked working fluid is discharged from a discharge space 115 via the discharge port 113 in accordance with a compression stroke. The compressed gas passes through an upper passage 182 of an outer peripheral portion of the electric motor stator 180, a gap between the electric motor stator 180 and the electric motor rotor 181 and the like, via an outer peripheral gas passage 116 provided at a far position from a lubricating oil in an outer peripheral portion of the fixed scroll 110 and the main frame 130, cools the electric motor, passes through the upper communication path 211 and is discharged out of the compressor from the discharge pipe 101.

On the basis of the rotation of the driving shaft 170, the trochoid pump 190 is driven so as to take up a lubricating oil from the oil feeding pipe 191, supply the oil to the auxiliary bearing 161 via the oil feeding path 171 provided within the driving shaft and thereafter flow out from an auxiliary bearing end portion to a compressor mechanism portion chamber. The lubricating oil passing through the oil feeding path 171 lubricates an orbiting bearing 124 from a space in a drive shaft end portion, lubricates a main bearing 131 via a center portion space 152 sealed by a seal ring 150 and kept at a discharge pressure, is introduced to an oil discharge pipe 132 from an oil discharge hole provided in the frame and is discharged to a sealed container bottom portion at a far position from the outer peripheral gas passage 116. The seal ring 150 is received in a ring-like groove.

A part of the lubricating oil introduced to the center portion space 152 leaks out from the seal ring 150 so as to be introduced to the outer peripheral portion space 153, lubricates the Oldham ring 140 and the end plate surface forming an orbiting scroll end plate sliding portion and is introduced to the suction space 114 of the compressor chamber. Further, a part of the lubricating oil enters into the compressor chamber from a communication hole 126, is discharged together with a refrigerant gas, is separated within the sealed container, and is returned to a lubricating oil tank in a lower portion of the sealed container. A lot of lubricating oil discharged to the center portion space 152 is introduced to the oil discharge pipe 132 so as to be returned to the oil tank. As mentioned above, in accordance with the present embodiment, since an oil feeding system of the lubricating oil is separated from a compressed gas flow, it is possible to reduce a so-called oil ascent that the oil flows out of the compressor in accordance with the compressor gas flow.

The communication path 211 in the support plate 162 generates a pressure loss at a time of passing the refrigerant gas therethrough. On the basis of the pressure loss, a pressure in the space to which the discharge pipe is installed becomes somewhat lower than a pressure in the space containing the compressor mechanism portion. On the basis of the pressure difference, the lubricating oil in the compressor mechanism portion passes through the communication path 212 on a lower side of the support plate 162, and moves to the discharge pipe installed space, whereby it is possible to hold the lubricating oil in the discharge pipe installed space. The oil level difference is fluctuated in accordance with a cross sectional area of the communication path provided in the support plate and a flow rate of the refrigerant gas. The oil level difference H can be determined by the numerical expression (1).

[Numerical Expression 1]

$$H=(\zeta/2g)\cdot\{N\cdot G\cdot(P_S/P_d)^{1/n}/\rho A\}^2 \quad (1)$$

In which, N is rotational speed, G is refrigerant circulating amount (per one rotation), ζ is resistance coefficient, g is gravitational acceleration, $P_s$ is suction pressure, $P_d$ is discharge pressure, ρ is suction gas density, A is communication hole area, and n is polytropic exponent.

The oil level difference can be determined by the numerical expression (1), however, is particularly fluctuated largely by a change of the rotational speed N in an inverter operation. If the oil level difference H necessary at a time of the low-speed operation is set, the oil level difference H is enlarged at a time of the high-speed operation, the oil level reaches the discharge pipe portion, and the lubricating oil flows out of the compressor.

On the contrary, if the oil surface difference H necessary at a time of the high-speed operation is set, the oil level difference H becomes small at a time of the low-speed operation, and it is impossible to hold a necessary amount of lubricating oil in the discharge pipe installed space.

In the present embodiment, the communication hole area is set in accordance with the numerical expression (1) in such a manner that the necessary oil surface difference H can be obtained at a time of the low-speed operation. In the case that the oil level ascends at a time of the high-speed operation, the communication path 213 is provided so as to be open to the position which is above the center of rotation of the electric motor rotor 170 and below the discharge port 101, and moves the lubricating oil to the compressor chamber side if the oil level reaches the upper portion than the opening end, whereby the lubricating oil does not flow out of the compressor from the discharge pipe.

A valve 214 which is normally open is attached to the opening portion on the compressor chamber side of the communication path 213. If the compressor is operated, and the pressure difference is generated in the vicinity of the support plate 162, the valve 214 is closed on the basis of the pressure difference. If the oil level of the discharge pipe installed chamber ascends and the communication path 213 is filled with the lubricating oil, a closing force of the valve 214 is lost, the valve 214 comes to the normal open state, and the lubricating oil is moved to the compressor mechanism portion chamber. If the oil level descends and the communication pipe is filled only with the gas pressure within the discharge pipe installed chamber, the valve 214 is closed. The oil level in the discharge pipe installed chamber is kept approximately at the end surface position of the opening portion of the communication path 213, by repeating the operations mentioned above.

Figure 4:
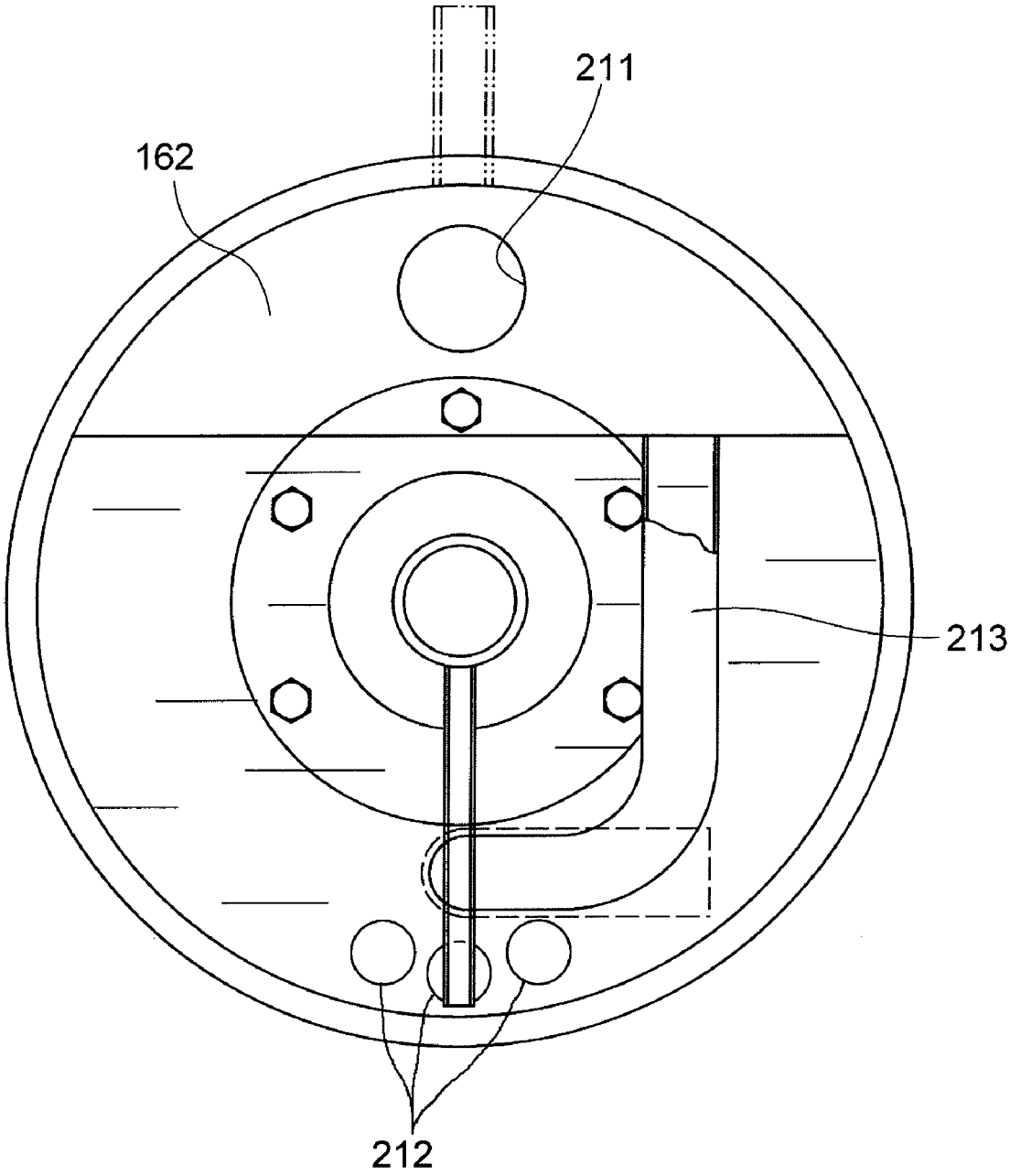
FIG. 4 is a right side elevational view of FIG. 1 and corresponds to an explanatory view when an oil level ascends.
Figure 5:
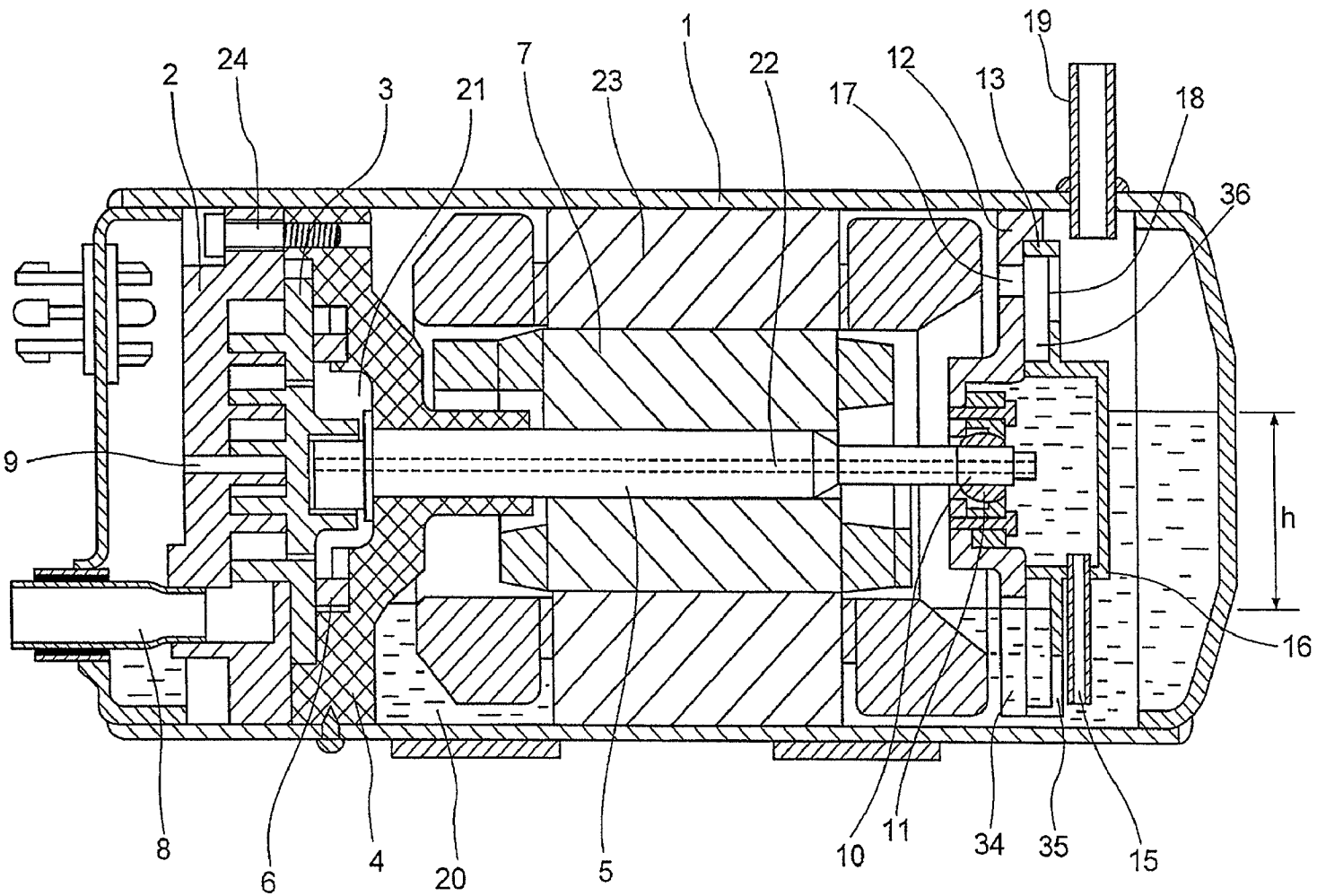
BACKGROUND ART FIG. 5
FIG. 5 is a view of a cross sectional structure of a conventional compressor.

FIG. 4 exemplifies the state mentioned above. As shown in FIG. 4, the opening portion of the communication path 213 is open to the position which is above the center of rotation of the electric motor rotor 170 and below the communication path 211. Accordingly, the oil level neither reach the communication path 211, nor flows out directly from the discharge pipe.

As described in FIG. 2, the oil is supplied to the oil supply path 171 provided within the drive shaft 170, the main bearing 131 and the auxiliary bearing 161 of the drive shaft 170 and the shaft support portion 123 of the orbiting scroll by the trochoid pump 190, and the lubricating oil reserved in the lower space of the sealed container 100 is supplied to each of the portions. The supplied oil reaches the center portion space 179 in the upper portion of the eccentric pin portion 172, thereafter lubricates the bearing 124 of the orbiting scroll, and flows out to the center space 152.

The oil flowing out to the center portion space 152 flows out to the outer peripheral portion space 153 at a small amount in the seal portion of the seal ring 150 provided in such a manner as to come into contact with the end surface of the orbiting scroll shaft support portion 123, however, most oil passes through the rolling bearing 131 corresponding to the main bearing, and is returned to the lubricating oil reservoir 200 in the lower portion via a path 183 provided in a side surface of a bearing cap 133 and the oil discharge pipe 132. Accordingly, it is possible to reduce the so-called oil ascent that the oil is taken out of the compressor in accordance with the flow of the refrigerant gas of the working fluid, without mixing the oil lubricating the shat support portion 123 of the orbiting scroll member, and the main bearing 131 and the auxiliary bearing 161 of the drive shaft 170 with the working fluid sucked from the suction port 102.

In this case, the path 183 is structured such that the lubricating oil is introduced between the sealed container 100 and the electric motor stator 180, as exemplified in FIG. 1. Shapes of the sealed container 100 and the electric motor stator 180 may b appropriately changed so as to be formed in a pipe shape or a communication pipe shape, or it is possible to employ a member formed in a pipe shape or a communication pipe shape.

The oil supply path 183 and the oil discharge pipe 132 provided in the center portion spaces 179 and 152, the rolling bearing 131 and the bearing cap 133 side surface are exposed to a pressure ascending effect caused by the pump effect and a pressure descending effect caused by the passage through the bearing portion and the gap portion, however, form a space having approximately same level as the discharge pressure. The outer peripheral portion space 153 is intermittently or continuously communicated with the compression chamber in process of compression via the communication hole 126, and comes to a pressure state between the suction pressure and the discharge pressure. According to a difference between the force pushing up the orbiting scroll, which force is generated by the pressure in the outer peripheral space 153 which is an intermediate pressure between the suction pressure and the discharge pressure and the pressure in the central spaces 179, 152 which is approximately the discharge pressure on the back surface side of the orbiting scroll lap, and the force pushing down the orbiting scroll which force is generated by the pressure produced on the compression chamber, the orbiting scroll is pushed in the direction of the fixed scroll 110, thereby, ensuring an airtightness of the compression chamber.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A horizontal type scroll compressor in which a compressor mechanism portion having a fixed scroll and a movable scroll and an electric motor portion rotationally driving a drive shaft of said compressor mechanism portion are stored in a sealed container, and a compressed gas compressed by the compressor mechanism portion is discharged from a discharge pipe provided in the sealed container, comprising:

a support plate separating an inside of said sealed container into a first space in which said compressor mechanism portion and said electric motor portion are stored, and a second space in which said discharge pipe is provided on an opposite side to said compressor mechanism portion within said sealed container, and supporting said drive shaft;

a first communication path for leading the compressed gas, disposed in a position upper than a supporting position of said drive shaft in said support plate;

a second communication path for communicating the first space and the second space and leading a lubricating oil, disposed in a position lower than the supporting position of said drive shaft in said support plate; and a third communication path for communicating a bottom portion of the first space and a space above the drive shaft within the second space, disposed in a position lower than the supporting position of said drive shaft in said support plate.

2. The horizontal type scroll compressor as claimed in claim 1, wherein said third communication path has a communication pipe communicating the bottom portion of the first space and the space above said drive shaft within the second space.

3. The horizontal type scroll compressor as claimed in claim 1, wherein a valve body is provided at an opening portion of the first space in said third communication path.

4. The horizontal type scroll compressor as claimed in claim 3, wherein said valve body is closed over a predetermined pressure.

5. The horizontal type scroll compressor as claimed in claim 1, wherein an opening portion of said discharge pipe on a side connected to said sealed container is not protruded into said sealed container.

6. The horizontal type scroll compressor as claimed in claim 1, wherein an opening portion of the third communication path close to the second space is positioned above a center of said drive shaft and below the first communication path.

* * * * *